US007681829B2

(12) United States Patent
Cyr et al.

(10) Patent No.: US 7,681,829 B2
(45) Date of Patent: Mar. 23, 2010

(54) NON-TWIST TAIL FOR JOINING TAPE ENDS

(76) Inventors: Gilles Cyr, 2840 Arrowhead, Eugene, OR (US) 97404; Elvin Dalebout, 90719 Dalewood Dr., Junction City, OR (US) 97448

( * ) Notice: Subject to any disclaimer, the term of this patent is extended or adjusted under 35 U.S.C. 154(b) by 1190 days.

(21) Appl. No.: 11/243,272

(22) Filed: Oct. 3, 2005

(65) Prior Publication Data

US 2007/0074817 A1 Apr. 5, 2007

(51) Int. Cl.
*B65H 19/00* (2006.01)

(52) U.S. Cl. ..... 242/551; 242/556

(58) Field of Classification Search ..... 242/551, 242/556

See application file for complete search history.

(56) References Cited

U.S. PATENT DOCUMENTS

| | | | | |
|---|---|---|---|---|
| 1,850,071 | A | 3/1932 | Boyer | |
| 2,361,857 | A | 10/1944 | McMullen | |
| 2,766,811 | A | 10/1956 | Armelin et al. | |
| 2,987,108 | A | 6/1961 | Kilmartin | |
| 3,072,354 | A | 1/1963 | Giles et al. | |
| 3,645,463 | A | 2/1972 | Holm | |
| 3,741,079 | A | 6/1973 | Bossons et al. | |
| 4,010,911 | A | 3/1977 | Heitmann | |
| 4,022,396 | A * | 5/1977 | Manchester et al. | 242/160.2 |
| 4,046,614 | A | 9/1977 | Zahn et al. | |
| 4,262,855 | A | 4/1981 | Haag | |
| 4,917,327 | A | 4/1990 | Asbury, Jr. et al. | |
| 5,029,768 | A | 7/1991 | Asbury, Jr. et al. | |
| 5,586,831 | A | 12/1996 | Tsubota et al. | |
| 5,740,983 | A * | 4/1998 | Earle et al. | 242/556 |
| 5,775,629 | A | 7/1998 | Cyr | |
| 6,325,324 | B1 | 12/2001 | Getz et al. | |
| 6,416,604 | B1 | 7/2002 | Nootbaar et al. | |
| 6,432,241 | B1 | 8/2002 | Congard et al. | |
| 6,596,111 | B2 | 7/2003 | Cyr et al. | |
| 6,688,363 | B2 | 2/2004 | Cyr et al. | |
| 6,737,138 | B2 | 5/2004 | Cyr et al. | |
| 6,802,467 | B2 * | 10/2004 | Abba et al. | 242/167 |
| 7,461,808 | B2 * | 12/2008 | Bradshaw et al. | 242/555.4 |

* cited by examiner

*Primary Examiner*—Sang Kim
(74) *Attorney, Agent, or Firm*—Chernoff, Vilhauer, McClung & Stenzel LLP

(57) ABSTRACT

A non-twist tape transfer system for interconnecting the trailing edge of tape from a first roll of tape to the leading edge of tape from a second roll of tape includes a first element which is attachable to the trailing edge of the tape on the first roll and a second element which is attachable to the leading edge of the tape on the second roll. A spindle which is attached to the holder the first roll is mounted on rotates with the roll and has a slot which releasably receives the first element in a manner such that the first element rotates with it. The second element attachable to the first element in a manner such that it does not rotate with the first element. When the tape starts to feed from the second roll the first element pulls out of the slot and proceeds with the tape.

8 Claims, 3 Drawing Sheets

NON-TWIST TAIL FOR JOINING TAPE ENDS

BACKGROUND OF THE INVENTION

In many applications, tape, ribbon and other flat elongate material is dispensed from a roll by pulling it off of the roll, thereby causing the roll to rotate about its central axis. It is desirable to attach the trailing end of tape from the roll of tape being fed to the leading edge of tape from another roll so that the dispensing process can continue indefinitely without having to stop the process each time a roll is emptied. However, because the first roll is rotating and the second roll is not rotating, the tape must be joined in a way which does not cause it to become twisted. A prior art system for accomplishing this is disclosed in Cyr, U.S. Pat. No. 5,775,629. In this system a hole is placed in the leading edge of the tape and a pivot is attached to the trailing edge of the tape either integrally or through an attachable tail piece of tape. The pivot is inserted into the hole to join the tape from two rolls together. The pivot allows the tape ends to rotate relative to one another thereby preventing their becoming twisted. While this system works, the joined ends of the tape tend to bounce around when the tape is being dispensed from the first roll so some twisting can occur.

BRIEF SUMMARY OF THE INVENTION

The subject invention overcomes this problem with the prior art non-twist tails by providing a first element which is attachable to the trailing edge of the tape on a first roll of tape and a second element which is attached to the trailing edge of the tape on a second roll of tape. The first element is releasably attached to a spindle, which rotates with the first roll of tape, so as to rotate with the spindle. The second element is rotatably attached to the first element in a manner such that rotation of the first element with the spindle does not cause rotation of the second element.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
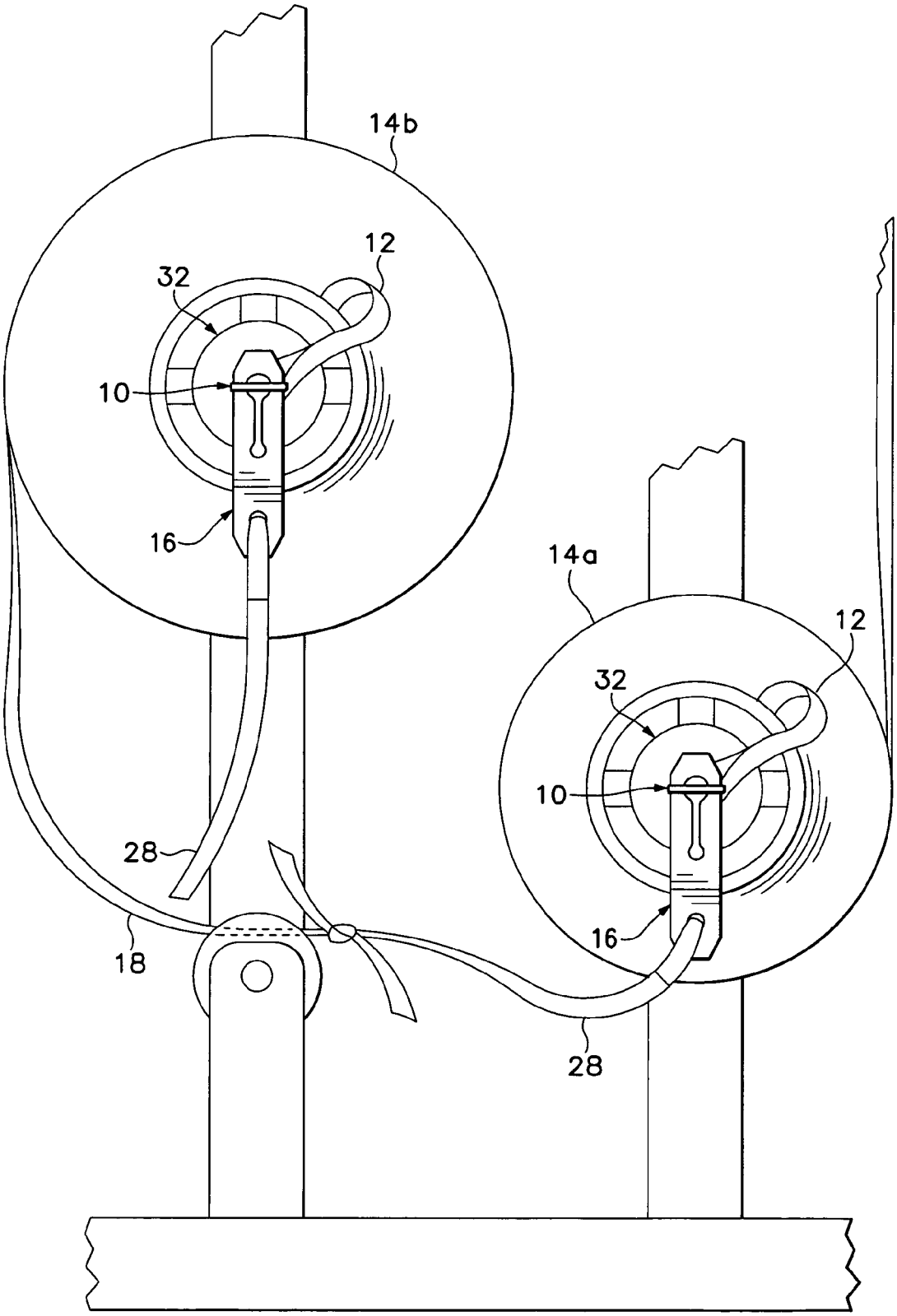
FIG. 1 is a side elevation view showing a tape dispensing apparatus embodying the non-twist tape transfer system of the subject invention.
Figure 2:
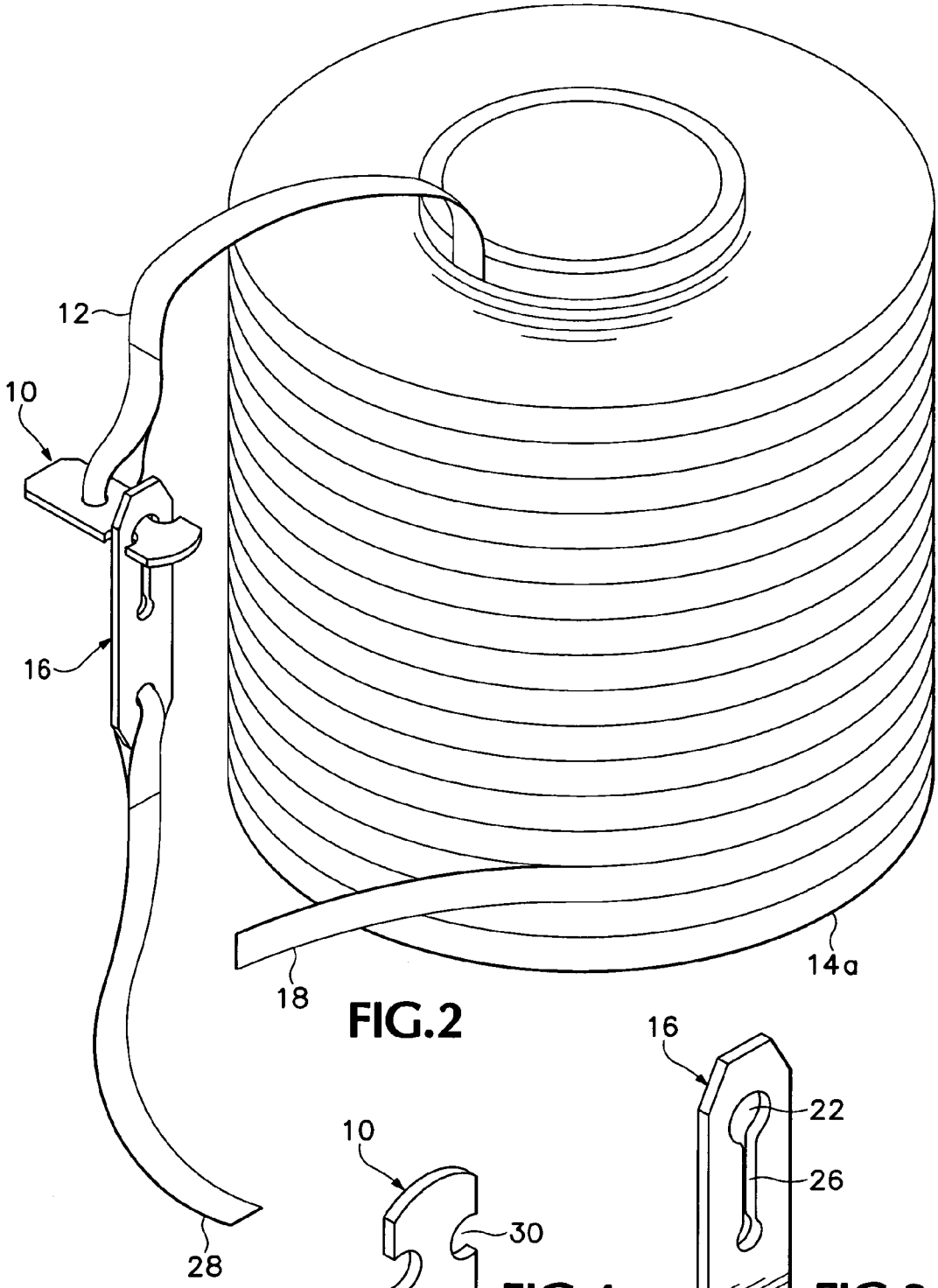
FIG. 2 is a perspective view of a roll of tape with the tape transfer system the subject invention attached.

Referring now to FIGS. 1 and 2 of the drawings, a non-twist tape transfer system includes a first element 10 which is attachable to the trailing edge 12 of tape from a first roll of tape 14*a*, and a second element 16 which is attachable to the leading edge 18 of tape from a second roll of tape 14*b*.

Figure 3:
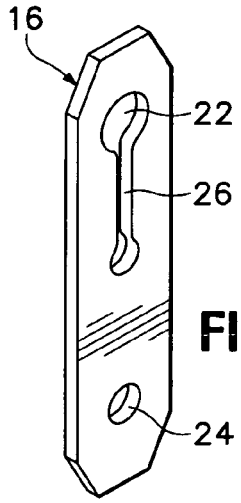
FIG. 3 is a perspective view of one element of the invention.

Referring now also to FIG. 3, the second element 16 is a thin planer elongate strip, preferably made from plastic, having a joint hole 22 at one end and an attachment hole 24 at the other end. An elongate slot 26 having a width which is slightly greater than the thickness of the first element 10 opens out of the joint hole 22. In the embodiment illustrated, the second element is attached to a tail tape 28 which in turn can be attached to the leading edge 18 of the tape on a roll. The tail tape 28 is passed through the attachment hole 24 in the second element 16 and looped back onto itself. If the tape is heat sealable tape the loop can be attached to the tail by heating, and if it is not heat sealable tape the loop can be attached to the tail by an adhesive. With this embodiment the tail tape 28 is attached to the leading edge of the tape on the roll at the site where the tape will be used by tying them together as shown in FIG. 1, or by any other means. The reason the second element is attached on site is because the leading edge of the tape in a roll must be affixed to the roll during shipping or it will become unwound, and this is more difficult to do with the second element attached. However, the second element can be attached directly to the leading edge of the tape on the roll if desired.

Figure 4:
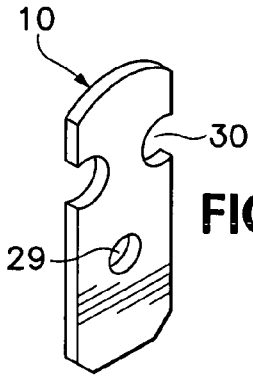
FIG. 4 is a perspective view of another element of the invention.

Referring now to FIG. 4, the first element 10 also is a thin planer elongate strip and also preferably is made of plastic. The first element has an attachment hole 29 at one end and a necked-down portion 30 at the other end. The necked-down portion 30 has a width which is slightly less than the diameter of the joint hole 22 in the second element 16. Thus, the first element 10 can be inserted into the slot 26 in the second element, moved upwardly so that the necked-down portion 30 is in the joint hole 22 and when the first element is oriented at 90 degrees with respect to the second element it can be rotated and the second joint element will not rotate with it. Because the trailing edge 12 of the tape is on the inside of the roll it cannot become unwound and the first element 10 can be pre-attached directly to the tape. This is done by inserting the trailing edge 12 of the tape through the attachment hole 29, looping it back over itself and affixing it in the same manner that the tape tail 28 is attached to the second joint element 16.

Figure 5:
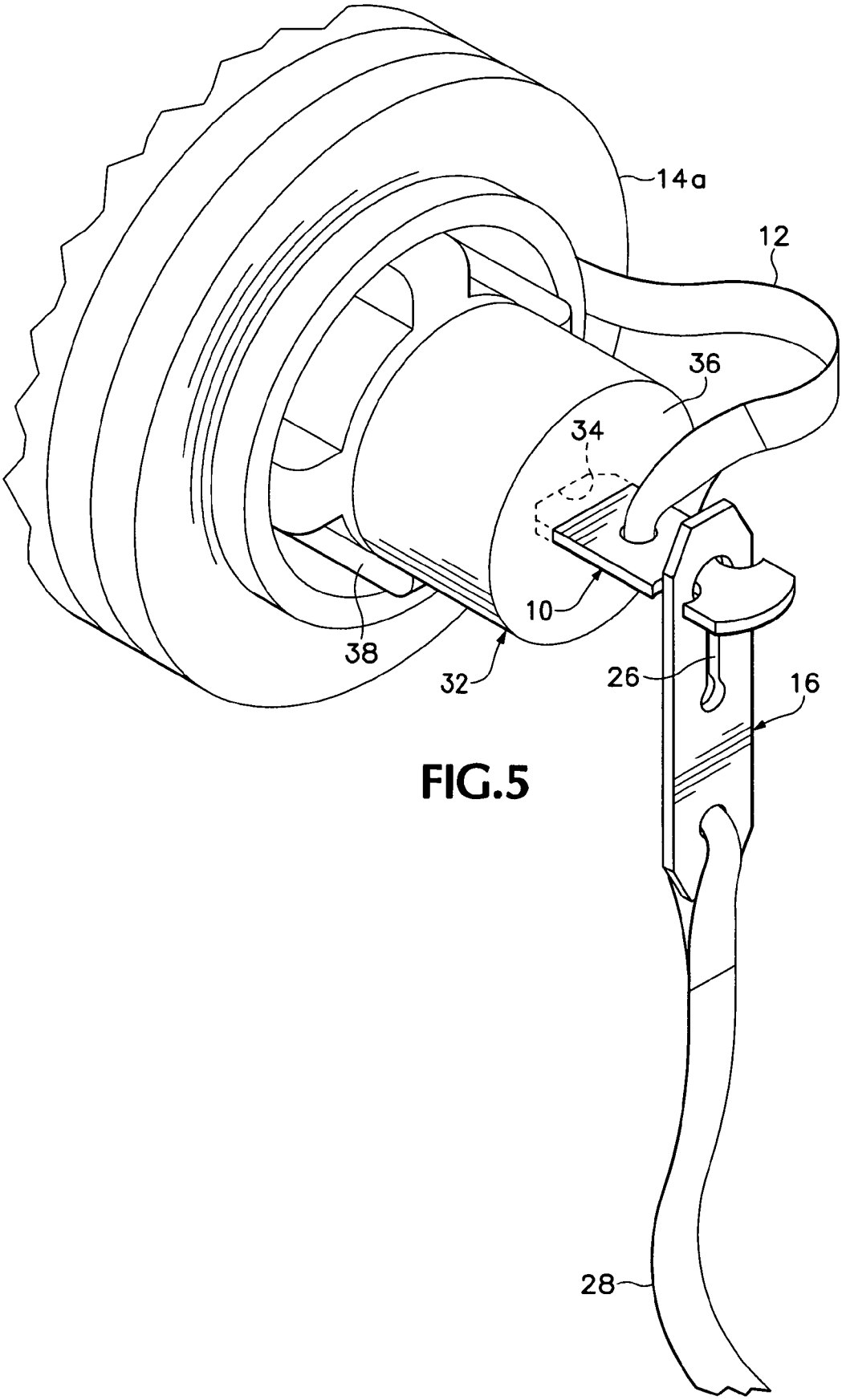
FIG. 5 is a fragmentary perspective view showing the invention attached on a roll of tape.

In order to maintain the first and second elements at right angles with respect to one another, and thus ensure free rotation of the first element in the second joint element when the roll is rotating, the end of the first element is releasably attached to a spindle 32 which is attached to the holder 28 which carries the roll and rotates with the roll, FIG. 5. This is accomplished by placing a slot 34 in the center of the end 36 of the spindle that loosely receives the end of the first element. When the first roll of tape is depleted the first element 10 pulls out of the slot 34 and both the first and second elements are pulled along with the tape from the second roll.

In operation the transfer from roll to roll is continuous with one of the two holders 38 first holding a first roll 14*a* and then holding a second roll 14*b* and the other holder 38 doing the opposite. This way tape can be dispensed indefinitely without having to stop.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A non-twist tape transfer system for interconnecting the trailing edge of tape from a first roll which is rotating about a central axis as tape is being dispensed from it, to the trailing edge of tape from a second roll of tape which is stationary, said system comprising:

(a) a first element which is attachable to a trailing edge of the tape on said first roll;

(b) a second element which is attachable to a leading edge of the tape on a second roll;

(c) a spindle that rotates coaxially with said first roll, said first element being attached to said spindle so as to rotate therewith; and (d) said first and second elements being joined such that rotation of said first element does not cause rotation of said second element.

2. The system of claim 1 wherein said first element is preattached to the trailing edge of the tape on said first roll.

3. The system of claim 1 wherein said second element is planar and has a joint hole defined therein having a predetermined diameter, and said first element is planar and has a necked-down portion having a width which is slightly less than said predetermined diameter.

4. The system of claim 3 wherein said second element includes a slot which extends from said joint hole, said slot being sized to allow said first element to be inserted therethrough.

5. The system of claim 1 wherein said spindle has an opening defined therein which releasably receives an end of said first element.

6. The system of claim wherein said first and second elements are made from a plastic material.

7. The system claim 1 wherein a tail piece of tape is attached to said second element.

8. The system of claim 7 wherein said tail piece of tape is tied to the leading edge of the tape from said second roll.

* * * * *

UNITED STATES PATENT AND TRADEMARK OFFICE

CERTIFICATE OF CORRECTION

PATENT NO. : 7,681,829 B2
APPLICATION NO. : 11/243272
DATED : March 23, 2010
INVENTOR(S) : Gilles Cyr It is certified that error appears in the above-identified patent and that said Letters Patent is hereby corrected as shown below:

At column 4, line 11, after the word "claim", please insert the number --1--.

Signed and Sealed this
Thirty-first Day of May, 2011

David J. Kappos

David J. Kappos
*Director of the United States Patent and Trademark Office*